United States Patent [19]

Rossetti

[11] Patent Number: 4,832,790

[45] **Date of Patent: * May 23, 1989**

[54] METHOD OF MAKING METAL MOLDS AND DIES

[75] Inventor: James J. Rossetti, Palmyra, Wis.

[73] Assignee: Advanced Tool Technologies, Inc., Lake Geneva, Wis.

[ * ] Notice: The portion of the term of this patent subsequent to Apr. 4, 2006 has been disclaimed.

[21] Appl. No.: 17,916

[22] Filed: Feb. 24, 1987

Related U.S. Application Data

[63] Continuation-in-part of Ser. No. 850,769, Apr. 11, 1986, abandoned.

[51] Int. Cl.[4] ..... C23F 1/02

[52] U.S. Cl. ..... 156/651; 156/658; 156/659.1; 252/79.2; 427/276; 427/277; 264/132; 264/293

[58] Field of Search ..... 156/628, 637, 639, 645, 156/650, 659.1, 664, 651, 658; 252/79.2, 79.4; 264/293, 132; 427/277, 276

[56] References Cited

U.S. PATENT DOCUMENTS

| | | | |
|---|---|---|---|
| 3,290,192 | 12/1966 | Kelley | 156/659.1 X |
| 4,035,226 | 7/1977 | Farber et al. | 156/659.1 X |
| 4,108,716 | 8/1978 | Pritchard et al. | 156/636 |
| 4,325,779 | 4/1982 | Rossetti | 156/651 |

*Primary Examiner*—David L. Lacey
*Assistant Examiner*—Thi Dang
*Attorney, Agent, or Firm*—Lee & Smith

[57] ABSTRACT

A method of forming a metal mold or die from a model of the mold contours. A workpiece for the mold is coated with a material which is resistant to an acidic etchant, and is then immersed in the etchant and brought into contact with a template for the metal mold or dies. Those portions of the coating contacted by the template are displaced until the template contacts the surface of the workpiece. The template is then withdrawn to permit the echant to etch any portions of the workpiece exposed by displacement of the coating. The process is progressively repeated until the surface of the workpiece conforms to any contouring of the surface of the template.

12 Claims, 2 Drawing Sheets

METHOD OF MAKING METAL MOLDS AND DIES

RELATED APPLICATION

This application is a continuation-in-part of U.S. Pat. application Ser. No. 850,769, filed Apr. 11, 1985, now abandoned.

BACKGROUND OF THE INVENTION

This invention relates to formation of metal dies or molds, and in particular to a method for forming a contoured mold surface by progressively etching the surface of a workpiece until the mold configuration is formed in the workpiece.

Metal molds or dies can be formed in several different manners. The present invention relates to manufacture of molds or dies by etching techniques where an etchant, such as an acidic bath, is used to etch a metal surface progressively in order to form the mold or die. Throughout the remainder of this description, the terms "mold" and "die" will be used interchangeably to mean a tool formed from a workpiece and which has a contoured surface for use in the production in quantity of three-dimensional products of metal, plastic or the like.

U.S. Pat. No. 4,325,779, issued on an invention of the same inventor as this application, relates to a method for forming a mold surface by etching techniques. However, in the disclosed method of U.S. Pat. No. 4,325,779, the technique is laborious, requiring removal of portions of a coating covering the mold workpiece surface, application of an etchant to etch any thus exposed metal, removal of the etchant and cleaning of the mold, reapplication of the coating to the entire mold workpiece surface, and then repetition of the procedure until sufficient depth of etching has been effected to form the mold. The method is labor intensive and quite slow due to the necessity for continual cycles of manual application and removal of the coating material and the etchant.

U.S. Pat. No. 3,290,192 discloses a method of continually forming surfaces by etching techniques. An item to be etched is immersed in an etching bath and a heated die is brought into contact with the surface of the item repeatedly in order to etch the surface. The etchant is kept relatively cool to minimize its etching capabilities, while the repeated pulsation of the die is intended to continually replenish fresh etchant between the tool face and the surface being etched. There is no coating to protect the surface being etched, requiring careful control of the temperature of the etchant and of the nature of the etchant to assure that other areas of the surface are not inadvertantly etched where etching is not desired.

SUMMARY OF THE INVENTION

The present invention comprises a method of forming a contoured surface in a workpiece in order to form a mold element therein by progressively and selectively etching a surface of the workpiece. A template is provided having a contoured surface which is a negative pattern of the contoured surface of a mold to be formed in the workpiece. A coating is applied to the workpiece, the coating being resistent to an etchant and comprising a viscous material that may be physically displaced at ambient temperature. The coated workpiece is then immersed in the echant, and the template is pressed against the coated workpiece to displace portions of the coating contacted by the template until the contoured surface of the template moves into contact with the workpiece. After such contact, the template is withdrawn from the coated workpiece and the etchant is permitted to etch those portions of the workpiece which are exposed by the displacement of the coating. The process is repeated without any extrinsic manipulation of the coating until the surface of the workpiece conforms to the contoured surface of the template.

In accordance with one form of the invention, the workpiece is heated before the process is begun. Preferably, the workpiece is heated to at least 90° F., or more, in order to assure that the acid etchant into which the workpiece is submerged is properly activated by the heat.

In accordance with the preferred form of the invention, a detergent such as common dish washing detergent is applied to the etchant as a wetting and release agent. It has been found that up to 6 drops of detergent per 16 ounces by volume of the etchant is sufficient to provide excellent wetting and release properties. Also, additional detergent can be applied to the etchant to retard the etching properties of the etchant. If at least 20 drops of the detergent are applied per 16 ounces by volume of the etchant, the etching process is retarded and additional detergent will further slow the etching process.

Although it is preferred that the process continue uninterrupted, because of accumulation of ash and for inspection purposes, the process can be periodically interupted, the workpiece cleaned, the coating reapplied, and then the workpiece reimmersed in the etchant to continue the etching process. The application has found that interuption of the process every ten to fifteen minutes is the maximum interval of interruption necessary.

The coating may be any suitable coating which may does not fully solidify at ambient temperature. In one form of the invention, the coating consists of a petroleum-based asphaltum and beeswax, which is warmed before application to the workpiece. It has been found that combination of 16 ounces by volume of the asphaltum and 4 ounces by volume of beeswax provides a suitable coating. In another form of the invention, the coating consists simply of a particular grease. Grease is defined as a viscous oil or a semi-solid lubricant, and lithium and silicone greases have been found to be particularly effective as coatings.

The liquid etchant may be composed of several suitable solutions. In accordance with the first form of the invention, the etchant consists of an acid mixture of 6 ounces distilled water, 7 ounces nitric acid, and 3 ounces of sulfuric acid. In accordance with the second form of the invention, the etchant consists of equal quantities of water and nitric acid.

BRIEF DESCRIPTION OF THE DRAWINGS

The invention is described in greater detail in the following description of an example embodying the best mode of the invention, taken in conjunction with the drawings, in which.

DESCRIPTION OF EXAMPLES EMBODYING THE BEST MODE OF THE INVENTION

Figure 1:
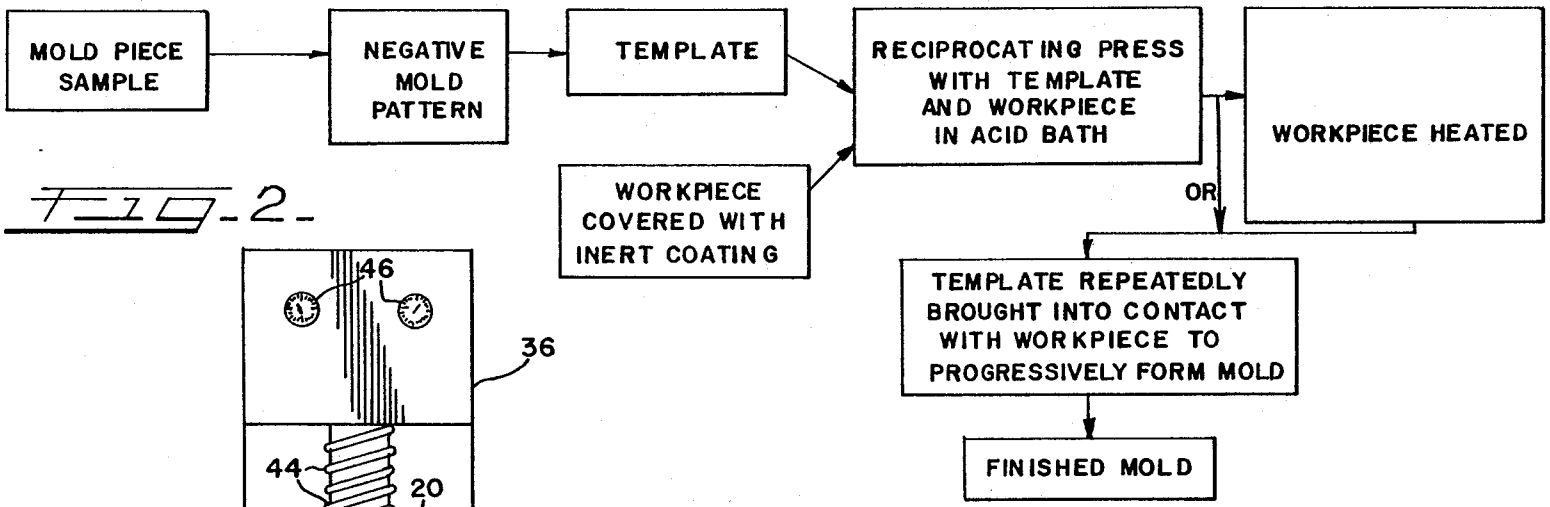
FIG. 1 is a block diagram outlining the novel method of the invention.

FIG. 1 sets forth in block form the steps taken in accordance with the process of the invention. The invention is intended to be utilized to duplicate a sample of an object to be molded. As illustrated in FIG. 1, that object is first selected and a negative mold pattern is then formed. Perferably, the mold pattern is made of a liquid material, such as silicone rubber, which readily conforms to the surface of the sample and, upon hardening, is readily removable from the sample.

After the mold pattern has been made, a template is made by pouring in liquid form a hardenable material, such as an epoxy resin, into the mold. The hardenable material must be inert to any etchant used, and must withstand the reciprocations of the process during the mold forming procedure. If necessary, the formed template can be embedded upon a supporting material so that it can be mounted in a reciprocating press.

The workpiece which is to be formed into the die or mold is coated on all exposed surfaces by a suitable composition which is inert to the etchant. The coating must be sufficiently viscous so that it does not flow at ambient temperatures, yet must be readily displaceable during the mold forming process. As explained above, one suitable coating is composed of a wax, such as beeswax or paraffin, which is added to a petroleum-based asphaltum or tar, such as the Seal Master Non-fibered Asphalt Coating, manufactured by Wikel Manufacturing Company, Sandusky, Ohio 44870. To 16 ounces by volume of the asphalt is added 4 ounces by volume of the beeswax.

In a second form of the invention, the coating consists solely of a grease, such a s typical lubricating grease for vehicles and machines. Grease is defined as a viscous oil or a semi-solid lubricant, and many types can be used. It has been found that two types of grease function well in my process. During what I term the initial "roughing" process, a white lithium grease is used. For the final "finishing", I use a silicone grease. Roughing may consume two-thirds or more of the etching process time. The white lithium grease can be NAPA Bulkamp Lithease white lithium grease #765-1393 manufactured by Bulkramp, Inc., Indianapolis, Ind. 46241. The silicone grease may be Dow-Corning High Vacuum Grease, manufactured by Dow-Corning Corp., Midland, Mich. 48640. Of course, if desired, a single grease may be used for the entire process.

After the template and the coated workpiece are prepared, they are installed in a reciprocating press such as that illustrated in FIG. 2, described below. The workpiece is immersed in an acidic etchant bath, while the template is installed in a reciprocating ram such that it can be brought into periodic and repeated contact with the coated workpiece.

In one form of the invention, the liquid etchant can consist of an acidic mixture of 6 ounces distilled water, 7 ounces nitric acid (38° Baume or 42° Baume), 3 ounces of sulfuric acid (63° Baume) and, if necessary to activate the acid, a strip of copper. It has been found that a strip of copper approximately 2 inches by 3 inches by 0.003 inches thick is sufficient. Depending on the type of steel employed in the workpiece, the etchant can also include up to ½ ounce muriatic acid.

In a second form of the invention, the etchant consists only of nitric acid. To each part nitric acid (42° Baume) is added an equal part distilled water. This form of etchant functions particularly well when the coating is grease.

During the etching process, an ash is formed when the etchant etches the surface of the workpiece. In order to assure that the ash does not interfere with the reciprocating process, and to further provide a wetting and release agent in the etchant, application of common dish washing detergent to the surface of the etchant assures that none of the ash (or the displaced coating) adheres to the surface of the template. Furthermore, the detergent displaces the ash to the outer edges of the container in which the coated workpiece is immersed during the etching process. It has been found that up to 6 drops of a common detergent, such as Lux Liquid, to a 16 ounce mixture of the second form of the etchant (equal parts of nitric acid and water) adequately performs the wetting and release duties. If additional detergent is applied to the etchant, the speed of etching begins to be reduced. It has been found that if at least 20 drops of detergent is applied to the etchant of the second form of the invention, the etching is noticably retarded, and additional detergent further slows the etching process.

In the second disclosed form of the invention, utilizing grease as the coating and nitric acid as the etchant, the workpiece is heated to 90° F or greater in order to activate the acid. Heating of the workpiece sufficiently to soften the coating is unnecessary, and alternatively, the acid can be activated by other means. Heating of the workpiece is most advantageous since only the acid immediately adjacent to the heated workpiece is activated by the heating.

The template is repeatedly brought into contact with the coated workpiece and withdrawn in order to progressively form the mold. Preferably, a rate of contact on the order of 20 per minute is adequate for rapid and accurate formation of the mold in the coated workpiece. After a suitable length of time, the mold is completed and is removed from the acidic etchant bath.

Figure 2:
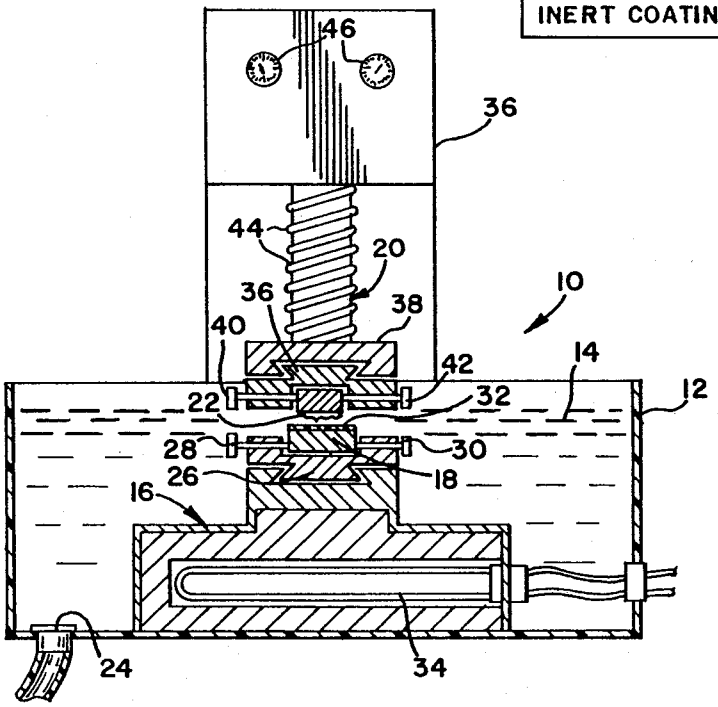
FIG. 2 is an elevational view, partially in cross section, of an apparatus used to practice the method of the invention.

FIG. 2 illustrates one form of an apparatus 10 for performing the method of the invention. Primary components of the apparatus 10 are a tank 12 filled with a etchant 14, a support 16 for the coated workpiece 18, and a ram 20 carrying the template 22.

The tank 12 is sufficiently large to hold an adequate quantity of the etchant 14 for completion of the process of forming a mold in the workpiece 18. A convenient drain 24 permits rapid withdrawal of the etchant 14 without siphoning or removal of the tank 12.

The support 16 is made of a material which is inert to the etchant 14. The support 16 includes a removable block 26 carrying a pair of clamps 28 and 30 for maintaining the workpiece 18 in place.

As explained above, in one form of the invention, it is preferred that the workpiece be heated in order to activate the acid. Heating is effective when the coating is grease and the etchant is nitric acid. One means of doing so is shown in FIG. 2, in which a heating element 34 is installed in the support 16. Temperature of the heating element is controlled externally of the tank 12 (means not illustrated) as necessary to assure maintenance of a proper temperature for activation of the acid immediately adjacent the workpiece 18 when within the tank 12. Should other means of activation of the acid be employed, or should activation of the acid be unnecessary, use of the heating element 34 is unnecessary.

The ram 20 is installed within a housing 36 for reciprocating movement toward and away from the stationary workpiece 18. The ram 20 includes a removable block 36 for carrying the template 22. As shown, the template 22 is affixed to or embedded upon a support element 38 which is held in place in the block 36 by means of a pair of adjustable clamps 40 and 42.

Gauges 46 may be provided as necessary for monitoring the temperature of the various elements of the apparatus 10. Other gauges, switches and suitable operational elements may be employed in the apparatus 10 to facilitate its operation and performance of the method of the invention.

Figure 3:
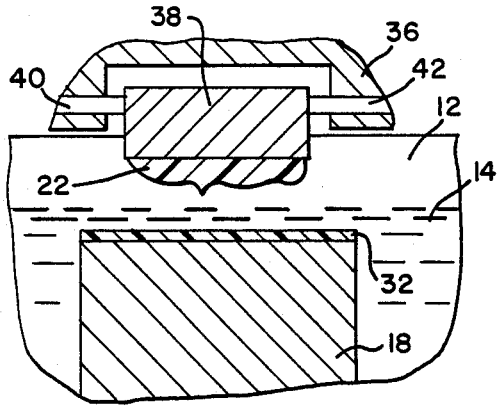
FIGS. 3 through 6 illustrate progressively the steps of forming a mold according to the invention.
Figure 4:
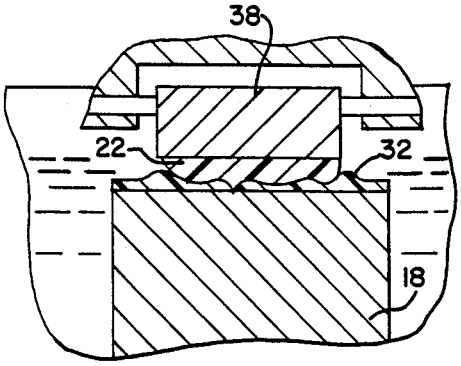

FIGS. 3 through 7 are enlarged partial cross-sectional views of a portion of the apparatus 10 showing the various steps of formation of a mold in the workpiece 18. FIG. 3 illustrates in enlarged fashion a portion of the apparatus 10 in the position shown in FIG. 2, with the template 22 poised above the as-yet uncontacted workpiece 18 with its undisplaced coating 32. The coating 32 has been illustrated across only the top face of the workpiece 18, it being evident that actually any exposed portions of the workpiece 18 would be covered with the coating 32 or otherwise appropriately protected from attack by the etchant 14.

Figure 5:
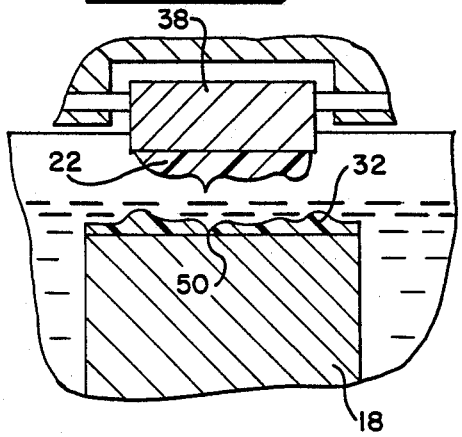
Figure 7:
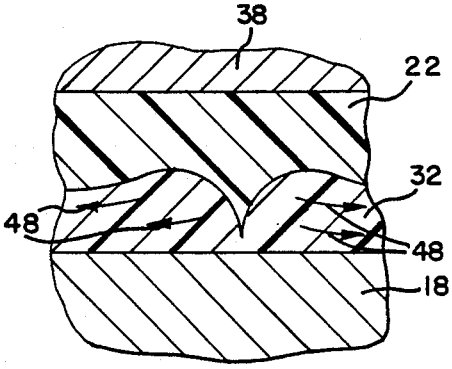
FIG. 7 is an enlarged view of the initial formation process illustrating displacement of the coating material.

After the apparatus 10 has been assembled as shown in FIG. 2, the ram 20 is lowered so that the template 22 engages the coating 32. As best shown in FIG. 7, arrows 48 illustrate local displacement of the coating 32 as the ram 20 is lowered and the coating material is displaced. When the template 22 has contact the workpiece 18 through the coating 32, the ram 20 is then raised as shown in FIG. 5, to permit the etchant 14 to etch any exposed surfaces of the workpiece 18. In the illustrated embodiment of the invention shown in FIG. 5, because the template 22 initially contacts the workpiece 18 at only one point, etching has begun only at that one location. Because the template 22 has been raised above the workpiece 18 and coating thereon, and because the coating is relatively viscous, the coating remains in place until contacted again by the template 22.

Figure 6:
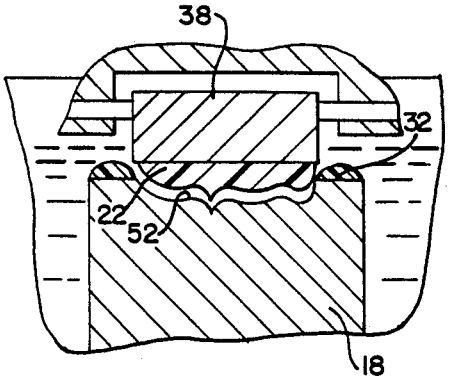

FIG. 6 illustrates the formation of a mold cavity 52 within the workpiece 18 after numerous successive reciprocations of the ram 20. As illustrated, the coating 32 has been displaced to the sides of the template 22, and the mold cavity 52 has been formed in an opposite image to the surface configuration of the template 22.

Figure 8:
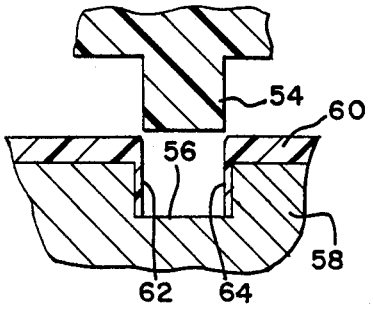
FIG. 8 is an enlarged cross-sectional illustration, somewhat exaggerated, illustrating coating of the vertical sides of a portion of the mold during the mold forming process in order to prevent etchant undercutting.

Of particular concern during the etching process is avoiding undercutting of any depressions formed in the workpiece which have essentially vertical sides. Illustrated in FIG. 8 is the means by which the invention avoids any such undercutting. FIG. 8 illustrates the forming process according to the invention, after some period of time, in which a template 54 has formed a cavity 56 within a workpiece 58 by displacement of a coating 60 in precisely the same manner as described above.

As the template 54 continually contacts the workpiece 58 and displaces the coating 60, the cavity 56 is formed. Because the etchant (not illustated) uniformly etches the material of the workpiece 58, the cavity 56 is formed slightly wider than the width of the template 54. Thus, when the template 54 returns into contact with the workpiece 58, the template 54 forces thin portions 62 and 64 of the coating 60 to flow into the space between the outer surface of the template 54 and the inner wall of the cavity 56. The thicknesses of the coating portions 62 and 64 have been exaggerated somewhat for illustration purposes. As will be seen, the coating portions 62 and 64 remain in place during further reciprocations of the template 54, assuring that the side walls of the cavity 56 are not undercut thoughout the remainder of the mold formation process.

The reciprocating cycle of the ram 20 is activated at maximum practical frequency to speed formation of the mold cavity 52 within the workpiece 18. Twenty reciprocations per minute have been found to be an adequate and feasible pulsation rate for the ram 20. The pulsation rate necessarily will be affected by the nature of the etchant 14, the type of steel or other material composing the workpiece 18, the temperature if any to which the workpiece 18 is heated, and the ambient temperature of the etchant 14. Also, since etchant brought to bear at the points of contact of the template may be present upon the surfaces of the template or even absorbed to some extent in the surface portions of the body of the template, the nature of the material of which the template is composed also affects the efficiency of the etchant corrosion process.

Ultimately, it is preferred that the entire forming process be completed without interruption from initial contact with the workpiece 18 until the final mold has been formed. However, as explained above, during the etching process, an ash is formed. Although the soap utilized does tend to displace the ash to the outer reaches of the tank 12, it has been found that periodic interruption of the process is advantageous. At 10 to 15 minute intervals, the process is halted, the workpiece 18 is removed form the etchant 14, is then cleaned and then recoated, and reinstalled in the apparatus 10 to continue the etching process.

It will be understood that a variety of materials, other than those specified by way of example, may be used for the temporary mold, for the template, for the workpiece and for the inert coating therefor, and for the etchant solution. A variety of workpiece materials and etchant systems are well known in the engraving and related arts. In addition to steel, metals such as copper, brass, zinc, aluminum and magnesium may be used for the mold workpiece and etchants employed will be selected for their corrosion properties with respect to the workpiece material used. Acidic etchants are most generally used, but an alkaline solution would be usable with aluminum.

ACHIEVEMENTS OF THE INVENTION

The herein described method of making dies for the production in quantity of metal copies of an original, as by die casting, requires no skilled craftsman and a minimum of labor. The process is susceptible to automation in that, once set up, the process of progressive corrosion by an etchant to form the die can be programmed and carried out to completion without intervention by an attendant. The method may be used to make molds for the production of plastic products by injection molding processes. As compared with procedures heretofore employed for making dies and molds, the costs are reduced by more than half in most cases. With such reductions in tooling costs, products can now be made which could not be made and marketed heretofore because of prohibitive tooling costs.

Various charges can be made to the invention without departing from the spirit thereof or scope of the following claims.

What is claimed is:

1. A method of forming a contoured surface in a workpiece in the form of a mold or die by selectively etching the surface thereof, comprising the steps of (a) providing a template having a contoured surface which is a negative pattern of the contoured surface to be formed in the workpiece, (b) applying a coating to the workpiece, the coating being resistant to an etchant and comprising a viscous material that may be physically displaced at ambient temperature, (c) immersing the coated workpiece in said etchant, (d) pressing the template against the coated workpiece and only displacing portions of the coating contacted by the template as the contoured surface moves into contact with the workpiece, and thereby exposing portions of the workpiece, (e) withdrawing the template from the coated workpiece without removing the displaced coating with the template to permit the etchant to etch portions of the workpiece exposed by displacement of the coating, and (f) repeating steps (d) through (e) until the surface of the workpiece conforms to the contoured surface of the template.

2. The method according to claim 1 including the step of heating the workpiece before step (d).

3. The method according to claim 2 in which the workpiece is heated to at least 90° F.

4. The method according to claim 1 including the step of applying a detergent in an amount such that it acts as a wetting and release agent to the etchant before step (c).

5. The method according to claim 4 in which up to 6 drops of detergent are applied per 16 ounces by volume of the etchant.

6. The method according to claim 1 including the step of applying detergent in an amount to retard etching of the etchant before step (c).

7. The method according to claim 6 in which at least 20 drops of detergent are applied per 16 ounces by volume of the etchant.

8. The method according to claim 1 including the steps of periodically interrupting step (f), cleaning the workpiece, reapplying the coating, reimmersing the coated workpiece in the etchant, and resuming step (f).

9. The method according to claim 8 in which step (f) is interrupted at minimum ten minute intervals.

10. The method according to claim 1 in which the coating consists of a flowable petroleum-based material.

11. The method according to claim 10 in which the coating is selected from the group consisting of silicone grease and lithium grease.

12. The method according to claim 1 in which the coating consists of a petroleum-based asphaltum and beeswax, and is warmed before step (b).

* * * * *